US008404417B2

(12) United States Patent
Fujita et al.

(10) Patent No.: US 8,404,417 B2
(45) **Date of Patent: *Mar. 26, 2013**

(54) ORGANIC PHOTORECEPTOR, IMAGE FORMING APPARATUS AND PROCESS CARTRIDGE

(75) Inventors: Toshiyuki Fujita, Hachioji (JP); Hirofumi Hayata, Fuchu (JP); Takeshi Ishida, Hachioji (JP); Masahiko Kurachi, Hino (JP); Seisuke Maeda, Akishima (JP); Seijiro Takahashi, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 191 days.

This patent is subject to a terminal disclaimer.

(21) Appl. No.: 12/988,506

(22) PCT Filed: Jul. 9, 2009

(86) PCT No.: PCT/JP2009/062515

§ 371 (c)(1),
(2), (4) Date: Oct. 18, 2010

(87) PCT Pub. No.: WO2010/018725

PCT Pub. Date: Feb. 18, 2010

(65) Prior Publication Data

US 2011/0033204 A1 Feb. 10, 2011

(30) Foreign Application Priority Data

Aug. 12, 2008 (JP) ..... 2008-207728

(51) Int. Cl.
*G03G 5/00* (2006.01)

(52) U.S. Cl. ..... 430/66; 430/132; 388/159

(58) Field of Classification Search ..... 430/66, 430/132; 399/159

See application file for complete search history.

(56) References Cited

U.S. PATENT DOCUMENTS

2006/0160002 A1* 7/2006 Qi et al. ..... 430/58.2

FOREIGN PATENT DOCUMENTS

| | | |
|---|---|---|
| JP | 06-118681 | 4/1994 |
| JP | 2001-125297 | 5/2001 |
| JP | 2003-167367 | 6/2003 |
| JP | 2003-207919 | 7/2003 |
| JP | 2004-138919 | 5/2004 |

OTHER PUBLICATIONS

Notice of Reasons for Refusal for application No. 2010-524694, mailed Aug. 28, 2012, 2 pgs.
Translation of Notice of Reasons for Refusal for application No. 2010-524694, mailed Aug. 28, 2012, 3 pgs.

* cited by examiner

*Primary Examiner* — Mark A Chapman
(74) *Attorney, Agent, or Firm* — Squire Sanders (US) LLP

(57) ABSTRACT

In the present invention, disclosed is an organic photoreceptor comprising a conductive support and provided thereon, a photosensitive layer and a protective layer provided on the photosensitive layer, the protective layer formed with alumina particles each comprising a reactive organic group. Also provided is an organic photoreceptor with which electrophotographic images having high durability together with high image quality can be obtained by improving a wear property of the organic photoreceptor up to the same level as that of an amorphous silicon photoreceptor, as well as by improving image flow and image blur which are easy to be generated at high temperature and high humidity.

13 Claims, 3 Drawing Sheets

ORGANIC PHOTORECEPTOR, IMAGE FORMING APPARATUS AND PROCESS CARTRIDGE

TECHNICAL FIELD

The present invention relates to an organic photoreceptor used for an electrophotographic system image forming apparatus, an image forming apparatus in which the organic photoreceptor is used, and a process cartridge thereof.

BACKGROUND

In recent years, an organic electrophotographic photoreceptor containing an organic photoconductive material (hereinafter, referred to also as an organic photoreceptor or to simply as a photoreceptor) has been most widely used as an electrophotographic photoreceptor. It is advantageous in the organic photoreceptor in comparison to other photoreceptors that a material suitable for various light exposure sources of visible light to infrared light is easy to be developed, a material with no environmental pollution can be selected, and manufacturing cost is low, but there is a problem such that mechanical strength is weak, the photoreceptor surface is deteriorated during printing or copying of a large number of sheets, and scratches are easy to be generated on the photoreceptor surface since durability is insufficient.

It has been strongly demanded to reduce wear caused by scraping through a cleaning blade or the like in order to improve durability of the organic photoreceptor. For this reason, a technique, in which a protective layer exhibiting high strength is provided on the photoreceptor surface, has been studied. For example, it is reported that a colloidal silica-containing curable siloxane resin is used for the surface layer of the photoreceptor (Patent Document 1). The colloidal silica-containing curable siloxane resin is easy to reduce electrical resistivity of the surface layer and to generate image blur and image flow, since both the curable resin having a siloxane bond (Si—O—Si bond) and colloidal silica exhibit moisture absorption.

Further, as to a curable resin applied to a protective layer, proposed is a protective layer made of the curable resin obtained via photopolymerization with a compound having an acryloyl group or the like (Patent Document 2). Filler such as metal oxide or the like is contained in the protective layer, but bonding between the filler and the curable resin is weak, strength for the protective layer is insufficient, and the problems such as image blur and image flow have not yet been solved sufficiently.

PRIOR ART DOCUMENT

Patent Document

Patent Document 1: Japanese Patent O.P.I. (Open to Public Inspection) Publication No. 6-118681

Patent Document 2: Japanese Patent O.P.I. Publication No. 2001-125297

DISCLOSURE OF THE INVENTION

Problems to be Solved by the Invention

It is an object of the present invention to solve the foregoing problems, and to provide an organic photoreceptor with which electrophotographic images having high durability together with high image quality can be obtained by improving a wear property of the organic photoreceptor up to the same level as that of an amorphous silicon photoreceptor, as well as by improving image flow and image blur which are easy to be generated at high temperature and high humidity, and further to provide an image forming apparatus possessing the organic photoreceptor and a process cartridge thereof.

Means to Solve the Problems

After considerable effort during intensive studies concerning problems of conventional protective layers as to a protective layer employed in the organic photoreceptor, the inventors have found out that it is desired that a curable resin and a filler in a protective layer are strongly bonded to each other, and the curable resin is hydrophobic in order to solve a wear resistance property, and image flow and image blur at high temperature and high humidity, resulting in completion of the present invention. That is, the invention of the present application can be accomplished by the following structures.

(Structure 1) An organic photoreceptor comprising a conductive support and provided thereon, a photosensitive layer and a protective layer provided on the photosensitive layer, the protective layer formed with alumina particles each comprising a reactive organic group.

(Structure 2) The organic photoreceptor of Structure 1, wherein the alumina particles each comprising a reactive organic group are obtained via reaction of alumina particles and a silane compound comprising a reactive organic group.

(Structure 3) The organic photoreceptor of Structure 2, wherein the reactive organic group in the silane compound comprising the reactive organic group is a polymerizable functional group.

(Structure 4) The organic photoreceptor of Structure 3, wherein the silane compound comprising the reactive organic group is represented by the following Formula (1):

Formula (1)

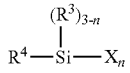

wherein $R^3$ represents an alkyl group having 1-10 carbon atoms or an aralkyl group having 1-10 carbon atoms, $R^4$ represents an organic group having a polymerizable double bond, X represents a halogen atom, an alkoxy group, an acyloxy group, an aminoxy group or a phenoxy group, and n is an integer of 1-3.

(Structure 5) The organic photoreceptor of Structure 4, wherein the alumina particles have a number average primary particle diameter of 1-300 nm.

(Structure 6) The organic photoreceptor of any one of Structures 1-5, comprising the protective layer formed via reaction produced by using a curable compound and the alumina particles each comprising the reactive organic group.

(Structure 7) The organic photoreceptor of Structure 6, comprising the protective layer formed via reaction produced by using the curable compound and the alumina particles each comprising the reactive organic group.

(Structure 8) The organic photoreceptor of Structure 7, wherein the curable compound is a compound comprising a C═C double bond.

(Structure 9) The organic photoreceptor of Structure 8, wherein the compound comprising a C═C double bond is a compound comprising an acryloyl group or a methacryloyl group.

(Structure 10) The organic photoreceptor of Structure 9, wherein a ratio Ac/M is within the following range, wherein Ac represents the number of the acryloyl groups or the methacryloyl groups, and M represents molecular weight of the compound comprising the acryloyl group or the methacryloyl group: $0.005<Ac/M<0.012$.

(Structure 11) The organic photoreceptor of Structure 1, wherein the reactive organic group comprises a polymerizable functional group.

(Structure 12) The organic photoreceptor of Structure 11, wherein the reactive organic group comprises a group comprising a C=C double bond.

(Structure 13) The organic photoreceptor of Structure 12, wherein the polymerizable functional group comprises a radical polymerizable functional group.

(Structure 14) The organic photoreceptor of Structure 1, comprising the protective layer formed via reaction between the alumina particles each comprising the reactive organic group to each other.

(Structure 15) An image forming apparatus comprising a charging device, a light exposure device and a developing device around the organic photoreceptor of Structure 1 to form images repetitively.

(Structure 16) A process cartridge used for the image forming apparatus of Structure 15 comprising the organic photoreceptor of Structure 1 and at least one of a charging device, an imagewise light exposure device and a developing device integrally, the process cartridge installed in the image forming apparatus as a detachable unit.

Effect of the Invention

Strength against wear and scratch on the surface of a photoreceptor is drastically improved by using a photoreceptor of the invention in the present application, whereby surface scratch resistance and a wastage amount on the surface of the photoreceptor are improved, resulting in drastic improvement of image blur or the like at high temperature and high humidity.

DESCRIPTION OF THE PREFERRED EMBODIMENTS

Figure 1:
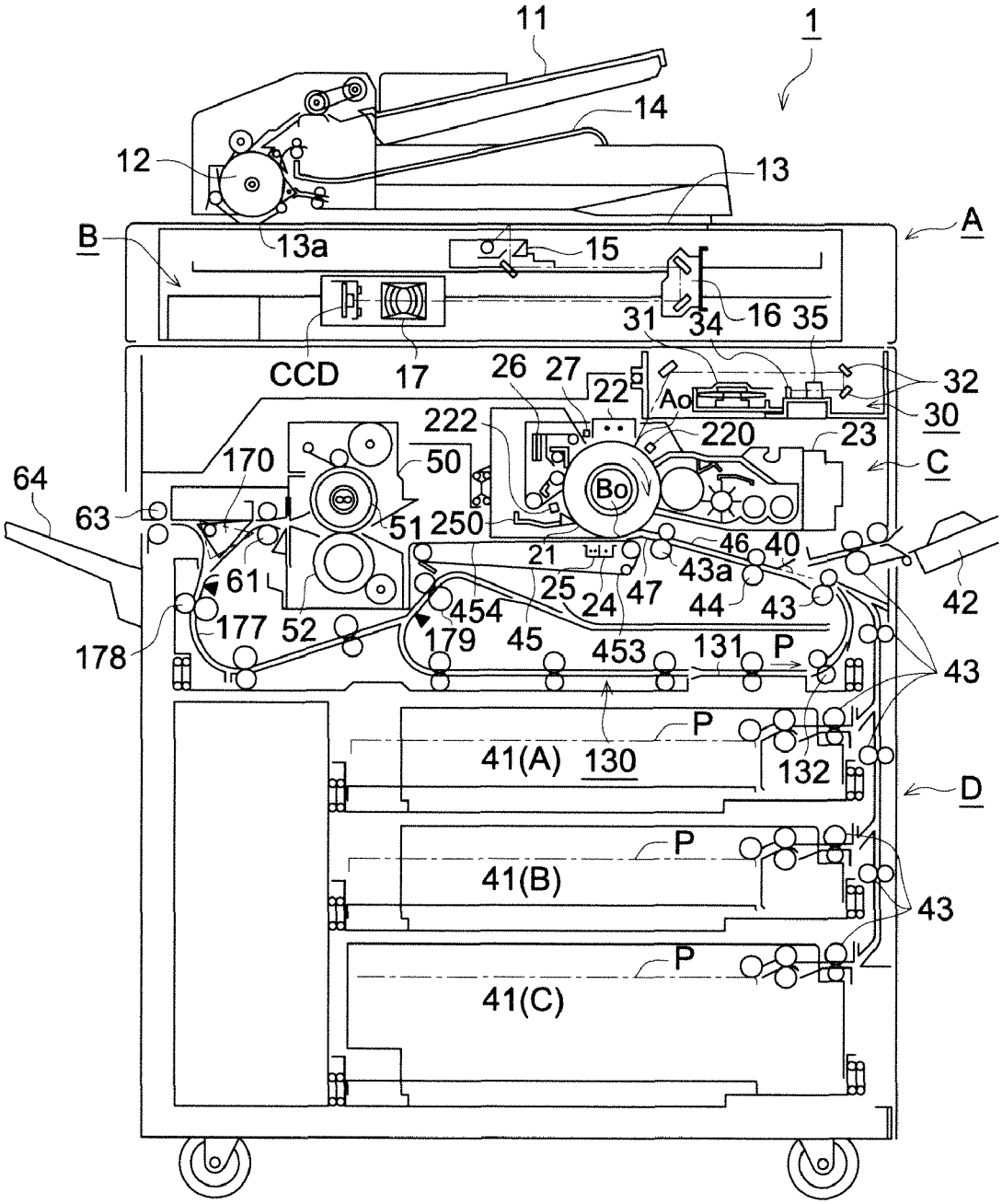
FIG. 1 is a schematic diagram showing an image forming apparatus in which functions of the image forming apparatus in the present invention are installed.

Alumina particles each having a reactive organic group used in the present invention will be described.

As the reactive organic group used in the present invention, cited is a radically polymerizable functional group such as an acryloyl group, a methacryloyl group or the like. Further, a cyclic ether structure such as epoxy, oxetane or the like can be also provided as a cationic polymerizable functional group.

The alumina particles each having a reactive organic group used in the present invention can be prepared as described below.

That is, the following Formula (1):

Formula (1)

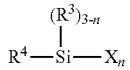

wherein $R^3$ represents an alkyl group having 1-10 carbon atoms or an aralkyl group having 1-10 carbon atoms, $R^4$ represents an organic group having a polymerizable double bond, X represents a halogen atom, an alkoxy group, an acyloxy group, an aminoxy group or a phenoxy group, and n is an integer of 1-3. They can be prepared by reacting alumina particles and a silane compound represented by the foregoing formula.

A silane compound reacted with alumina particles, which has a silyl group or a silyl group exhibiting a hydrolytic property in particular, is not specifically limited as long as it is a compound capable of being radically polymerized later on. Examples of the compound represented by the above-described Formula (1) are shown below.

S-1 $CH_2{=}CHSi(CH_3)(OCH_3)_2$
S-2 $CH_2{=}CHSi(OCH_3)_3$
S-3 $CH_2{=}CHSiCl_3$
S-4 $CH_2{=}CHCOO(CH_2)_2Si(CH_3)(OCH_3)_2$
S-5 $CH_2{=}CHCOO(CH_2)_2Si(OCH_3)_3$
S-6 $CH_2{=}CHCOO(CH_2)_2Si(OC_2H_5)(OCH_3)$
S-7 $CH_2{=}CHCOO(CH_2)_3Si(OCH_3)_3$
S-8 $CH_2{=}CHCOO(CH_2)_2Si(CH_3)Cl_2$
S-9 $CH_2{=}CHCOO(CH_2)_2SiCl_3$
S-10 $CH_2{=}CHCOO(CH_2)_3Si(CH_3)Cl_2$
S-11 $CH_2{=}CHCOO(CH_2)_3SiCl_3$
S-12 $CH_2{=}C(CH_3)COO(CH_2)_2Si(CH_3)(OCH_3)_2$
S-13 $CH_2{=}C(CH_3)COO(CH_2)_2Si(OCH_3)_3$
S-14 $CH_2{=}C(CH_3)COO(CH_2)_3Si(CH_3)(OCH_3)_2$
S-15 $CH_2{=}C(CH_3)COO(CH_2)_3SiOCH_3)_3$
S-16 $CH_2{=}C(CH_3)COO(CH_2)_2Si(CH_3)Cl_2$
S-17 $CH_2{=}C(CH_3)COO(CH_2)_2SiCl_3$
S-18 $CH_2{=}C(CH_3)COO(CH_2)_3Si(CH_3)Cl_2$
S-19 $CH_2{=}C(CH_3)COO(CH_2)_3SiCl_3$
S-20 $CH_2{=}CHSi(C_2H_5)(OCH_3)_2$
S-21 $CH_2{=}C(CH_3)Si(OCH_3)_3$
S-22 $CH_2{=}C(CH_3)Si(OC_2H_5)_3$
S-23 $CH_2{=}CHSi(OCH_3)_3$
S-24 $CH_2{=}C(CH_3)Si(CH_3)(OCH_3)_2$
S-25 $CH_2{=}CHSi(CH_3)Cl_2$
S-26 $CH_2{=}CHCOOSi(OCH_3)_3$
S-27 $CH_2{=}CHCOOSi(OC_2H_5)_3$
S-28 $CH_2{=}C(CH_3)COOSi(OCH_3)_3$
S-29 $CH_2{=}C(CH_3)COOSi(OC_2H_5)_3$
S-30 $CH_2{=}C(CH_3)COO(CH_2)_3Si(OC_2H_5)_3$
S-S1 $CH_2{=}CHCOO(CH_2)_2Si(CH_3)_2(OCH_3)$
S-S2 $CH_2{=}CHCOO(CH_2)_2Si(CH_3)(OCOCH_3)_2$
S-S3 $CH_2{=}CHCOO(CH_2)_2Si(CH_3)(ONHCH_3)_2$
S-S4 $CH_2{=}CHCOO(CH_2)_2Si(CH_3)(OC_6H_5)_2$
S-S5 $CH_2{=}CHCOO(CH_2)_2Si(C_{10}OH_{21})(OCH_3)_2$
S-S6 $CH_2{=}CHCOO(CH_2)_2Si(CH_2C_6H_5)(OCH_3)_2$

Further, the silane compound having a radically polymerizable reactive organic group as described below, other than the compound represented by foregoing Formula (1) may also be used.

S-31

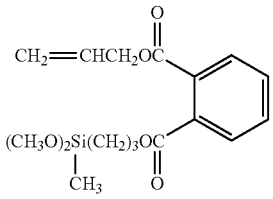

S-32

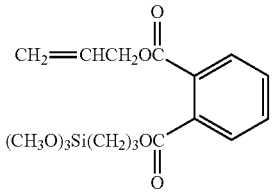

S-33

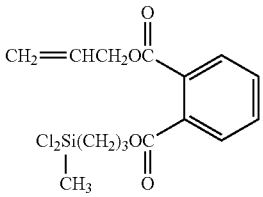

S-34

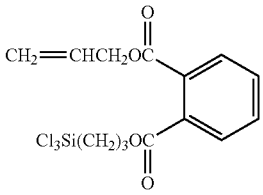

S-35

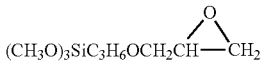

S-36

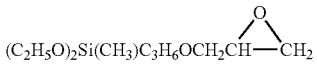

S-37

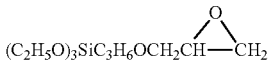

These silane compounds can be used singly or in combination with at least two kinds.

Alumina particles can be subjected to a surface treatment with a silane compound represented by foregoing Formula (1) or the like to obtain alumina particles each having a reactive organic group of the present invention. In order to conduct this surface-coating treatment, it is preferred to conduct the treatment with 0.1-100 parts by weight of a silane compound as a surface-treating agent and 50-5000 parts by weight of a solvent with respect to 100 parts by weight of alumina particles employing a wet system media dispersing type apparatus.

A surface-treating method by which alumina particles having been subjected to the surface-coating treatment with a silane compound evenly and further finely are manufactured will be described below.

Namely, when a slurry (suspension liquid of solid particles) containing alumina particles and a silane compound as a surface-treating agent is pulverized in a wet process, the alumina particles are micrified and a surface treatment for the alumina particles are accelerated at the same time. Thereafter, the solvent is removed to make the particles to be in the form of powder, whereby even and finer alumina particles having been subjected to the surface treatment with a silane compound can be obtained.

The wet system media dispersing type apparatus utilized in the present invention as a surface treatment apparatus is an apparatus having the step of pulverizing and dispersing alumina coagulated particles by which beads are filled in a container as dispersion media, and a stirring disk placed perpendicularly to a rotating shaft is further rotated at high speed. The structure of the apparatus does not have any problem, as long as alumina particles are sufficiently dispersed, and can be subjected to a surface treatment during the surface treatment applied to aluminum particles. For example, various types such as a vertical type or a horizontal type, a continuous type or a batch type and so forth are usable. Specifically, usable examples thereof include a sand mill, an Ultra visco mill, a Pearl mill, a Grain mill, a DINO-mill, an agitator Mill, a dynamic mill and so forth. In the case of these dispersing type apparatuses, fine pulverization and dispersion are conducted via impact crush, friction, shear force, and shear stress by use of pulverizing media such as balls, beads or the like.

As beads used in the above-described sand grinder mill, balls made of raw material such as glass, alumina, zircon, zirconia, steel, flint stone and so forth are usable, but those made of zirconia or zircon are specifically preferable. As to size of beads, beads each having a diameter of about 1-2 mm are conventionally used, but beads each having a diameter of about 0.3-1.0 mm are preferably used in the present invention.

Various materials such as stainless, nylon, ceramics and so forth are usable for a disk and an inner wall of container used for the wet system media dispersing type apparatus, but in the case of the present invention, a disk and an inner wall of a container made of ceramics such as zirconia or silicon carbide are specifically preferable.

Alumina particles each having a reactive organic group can be obtained via a surface treatment with a silane compound represented by Formula (1) by a wet treatment as described above.

Alumina particles each having a reactive organic group obtained in this way can form a protective layer via reaction between these alumina particles to each other, but a protective layer is preferably formed via reaction with a curable compound of the present invention as described below.

That is, as a compound reacted with a reactive organic group in an alumina particle (a curable compound in the invention of the present application), various compounds each having a C═C double bond, an epoxy compound having a cyclic ether structure and an oxetane compound are usable.

As to the above-mentioned curable compound, preferable is a monomer which becomes a resin conventionally utilized as a binder resin for a photoreceptor, such as polystyrene, polyacrylate and so forth via exposure to actinic rays such as UV radiation, electron beams or the like for polymerization (curing). In the case of a radical polymerizable monomer, specifically, preferable examples thereof include a styrene based monomer, an acrylic based monomer, a methacrylic monomer, a vinyltoluene based monomer, a vinyl acetate based monomer, and a N-vinylpyrrolidone based monomer. Of these, especially, a curable compound having an acryloyl group or a methacryloyl group is preferable since it is possible to be cured in small light quantity or in short duration.

Further, examples of the cationic polymerizable monomer include a vinylether compound, an oxetane compound and so forth, but an oxetane compound is preferable.

In the present invention, these curable compounds may be used singly or be mixed in combination.

Examples of the curable compound are shown below.

In the present invention, the following acrylic compound can be preferably used as a curable compound.

An acrylic compound is a compound having an acryloyl group ($CH_2$═CHCO—) or a methacryloyl group ($CH_2$═$CCH_3$CO—). In addition, the number of Ac groups (the number of acryloyl groups) shown below represents the number of acryloyl groups or methacryloyl groups in the molecule.

| Exemplified compound No. | Structural formula | The number of Ac groups |
|---|---|---|
| 1 | 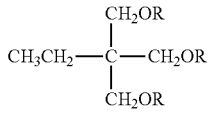 | 3 |
| 2 | 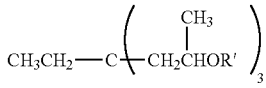 | 3 |
| 3 | 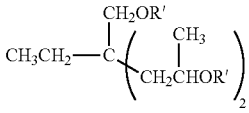 | 3 |
| 4 | 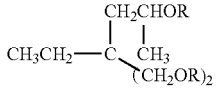 | 3 |
| 5 | 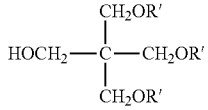 | 3 |
| 6 | 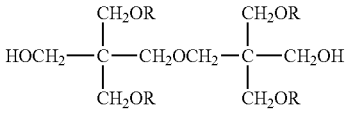 | 4 |
| 7 | 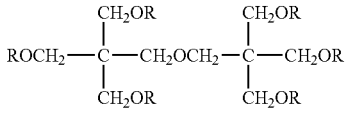 | 6 |
| 8 | 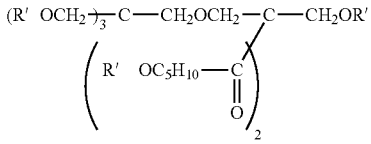 | 6 |
| 9 | 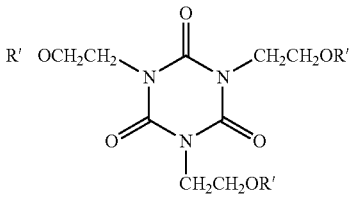 | 3 |
| 10 | $CH_3CH_2C(CH_2OC_3H_6OR)_3$ | 3 |
| 11 | 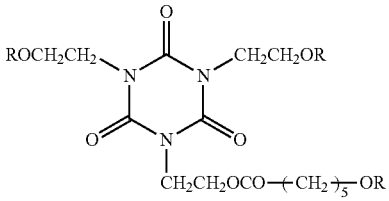 | 3 |

-continued
| | | |
|---|---|---|
| 12 | $(ROCH_2)_3C—O—C(CH_2OR)_3$ | 6 |
| 13 | $(ROCH_2)_3C—CH_2OCH_2—C(H)(CH_2OR)_2$ | 5 |
| 14 | $(ROCH_2)_3C—CH_2OCH_2—C(CH_3)(CH_2OR)_2$ | 5 |
| 15 | $(ROCH_2)_3C—CH_2OCH_2—C(CH_2OH)(CH_2OR)_2$ | 5 |
| 16 | $(R'OCH_2)_3C—CH_2OCH_2—C(CH_2OR')(CH_2OH)_2$ | 4 |
| 17 | $(ROCH_2)_3C—O—C(CH_2OH)(CH_2OR)_2$ | 5 |
| 18 | 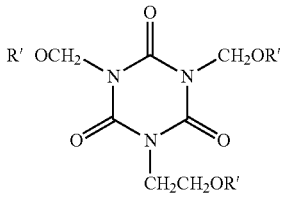 | 3 |
| 19 | $CH_3CH_2C(CH_2CH_2OR)_3$ | 3 |
| 20 | $HOCH_2—C\left(CH_2O—C(=O)CH_2CH_2CH_2CH_2CH_2OR\right)_3$ | 3 |
| 21 | 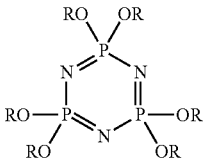 | 6 |
| 22 | 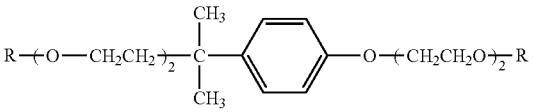 | 2 |
| 23 | 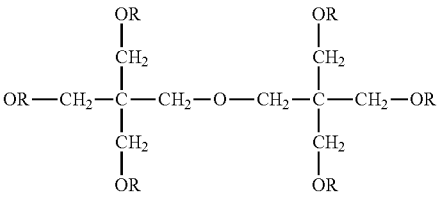 | 6 |
| 24 | 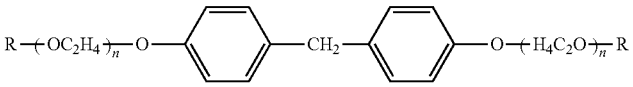 (n ≈ 2) | 2 |

-continued
| | | |
|---|---|---|
| 25 | 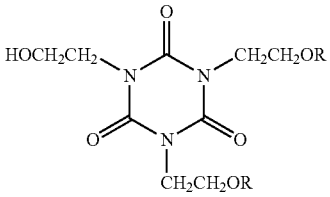 | 2 |
| 26 | $R\text{—}(OC_3H_6)_3\text{—}OR$ | 2 |
| 27 | 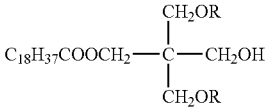 | 2 |
| 28 | 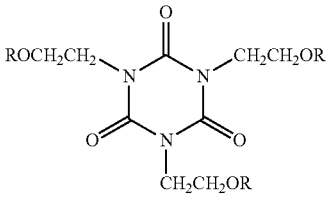 | 3 |
| 29 | $[R\text{—}(OC_3H_6)_n\text{—}OCH_2]_{13}\text{—}CCH_2CH_3$ (n ≈ 3) | 3 |
| 30 | 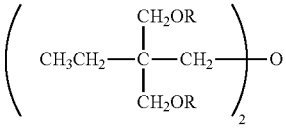 | 4 |
| 31 | $(ROCH_2)_4\text{—}C$ | 4 |
| 32 | $RO\text{—}C_6H_{12}\text{—}OR$ | 2 |
| 33 | 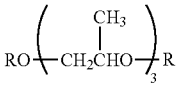 | 2 |
| 34 | 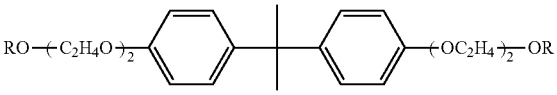 | 2 |
| 35 | 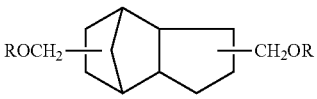 | 2 |
| 36 | $RO\text{—}(C_2H_4O)_9\text{—}R$ | 2 |
| 37 | 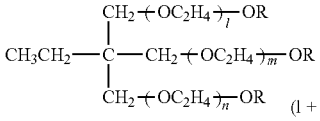 (l + m + n = 3) | 3 |
| 38 | 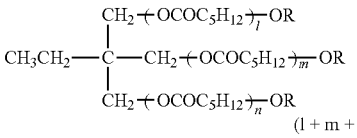 (l + m + n = 3) | 3 |

-continued

| Exemplified compound No. | Structural formula |
|---|---|
| 39 | $RO(CH_2)_2OCONHCH_2-C(CH_3)_2-CH_2CH(CH_3)(CH_2)_2NHCOO(CH_2)_2OR$ <br> $RO(CH_2)_2OCONHCH_2CH(CH_3)CH_2-C(CH_3)_2-(CH_2)_2NHCOO(CH_2)_2OR$ <br> A mixture of the above-described |
| 40 | $(ROCH_2)_3CCH_2OCONH(CH_2)_6NHCOOCH_2C(CH_2OR)_3$ |
| 41 | $C_2H_5-C(OR)_2-CH_2OCH_2-C(OR)_2-C_2H_5$ |
| 42 | $C_2H_5-C(CH_2OR')_3$ |
| 43 | $R'OCH_2-C(CH_2OR')_2-CH_2OCH_2-C(CH_2OR')_2-CH_2OR'$ |
| 44 | $R'OCH_2-C(CH_2OR')_3$ |

Each of R and R' in the above-described is shown below.

$R = -C(=O)-CH(H)-CH=CH_2$, $R' = -C(=O)-CH(CH_3)-CH=CH_2$

Further, examples of preferable oxetane compounds are shown below, but the present invention is not limited thereto.

45

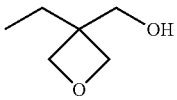

46

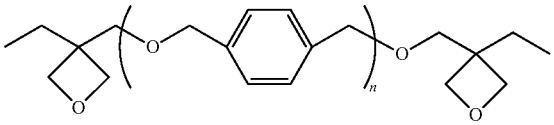

n = 1~3

47

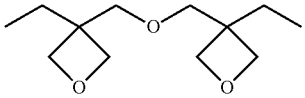

-continued

48

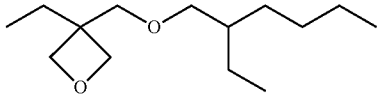

49

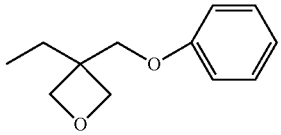

50

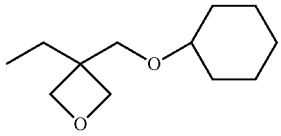

-continued

51

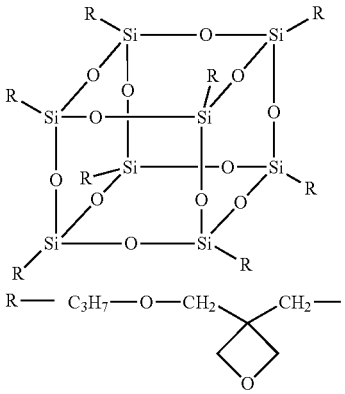

52

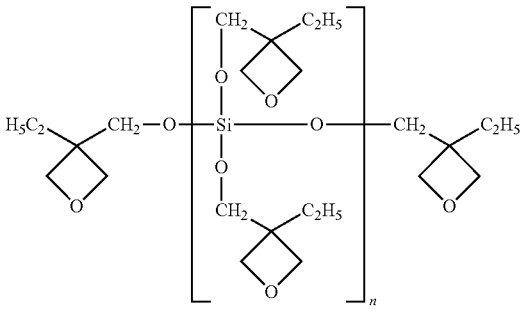

n = 5(Ave)

53

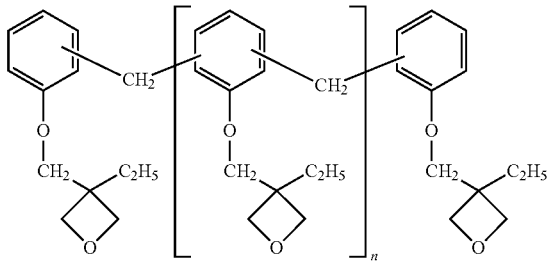

n = 3(Ave)

54

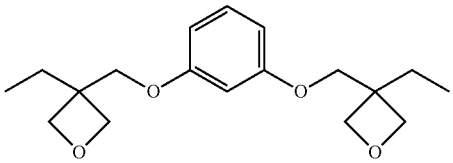

55

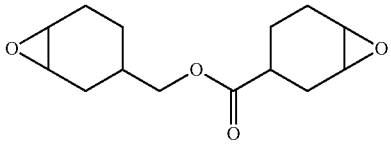

56

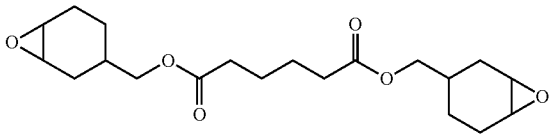

-continued

57

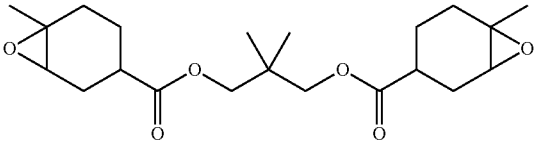

58

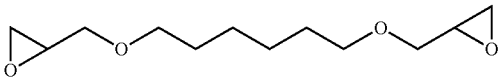

59

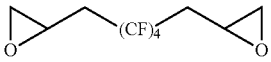

60

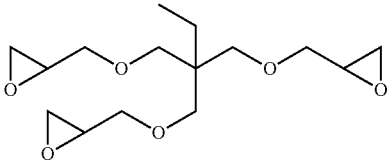

As the epoxy compound, cited can be aromatic epoxide, alicyclic epoxide and aliphatic epoxide.

A curable compound having 2 functional groups or more is preferable, and a curable compound having 4 functional groups or more is specifically preferable. It is preferred in the case of the foregoing acrylic compound that a ratio Ac/M is preferably in the following relationship, wherein Ac and M are the number of acryloyl groups or methacryloyl groups and the molecular weight of a compound having the foregoing acryloyl group or methacryloyl group, respectively. Not only high crosslinking density is obtained, but also a wear resistance property of the photoreceptor is improved by satisfying this relationship of Ac/M.

$$0.005 < Ac/M < 0.012$$

In the present invention, at least two curable compounds having different equivalent weight of the curable reactive group may be mixed and used.

(Alumina Particle)

Alumina particles used in present invention are not specifically limited as long as they are made of aluminum oxide, but alumina particles refined and sintered from bauxite, which have been widely manufactured industrially are preferably employed.

Alumina particles used in the present invention preferably have a number average primary particle diameter of 1-300 nm. Alumina particles used in the present invention more preferably have a number average primary particle diameter of 3-100 nm. When the particle size is too small, a wear resistance property is not sufficient. On the other hand, when the particle size is too large, particles scatter writing light, or obstruct light-curing, whereby there appears a possibility of insufficient wear resistance property.

The number average primary particle diameter of the above-described alumina particles can be obtained in such a way that an enlarged photograph of the particles is taken at a magnification of 10000 times with a scanning electron microscope (manufactured by JEOL Ltd.), and a photographed image in which 300 particles (except coagulated particles) are randomly taken in with a scanner is analyzed employing an automatic image processing analyzer LUZEX AP (manufactured by Nireco Corp.) fitted with a software version of Ver. 1.32 to calculate the number average primary particle diameter.

Alumina particles in a protective layer preferably have a content of 0.5-80% by weight, and more preferably have a content of 1-50% by weight.

When a protective layer is formed by use of a curable compound, as to an alumina particle ratio thereof, alumina particles preferably have 1-200 parts by weight with respect to 100 parts of the curable compound, and more preferably have 30-120 parts by weight with respect to 100 parts of the curable compound.

A curable layer can be formed by coating a coating solution in which a polymerization initiator, a filler, lubricant particles, an antioxidant or the like in addition to the above-described curable compound and alumina particles are blended and reacted, if desired, for a protective layer.

When reacting a curable compound of the present invention, employed may be a method of causing a cleavage reaction by electron beams, or a method of adding a radical polymerization initiator or a cationic polymerization initiator to conduct reaction via light or heat. As the polymerization initiator, any one of a photopolymerization initiator and a thermal polymerization initiator is usable. Further, both of the photopolymerization initiator and the thermal polymerization initiator can be used in combination.

As a radical polymerization initiator for these photocurable compounds, a photopolymerization initiator is preferable, and of these, an alkylphenone based compound or a phosphine oxide based compound is preferable. Specifically a compound having a α-hydroxyacetophenone structure or an acylphosphine oxide structure is preferable. Further, examples of compounds to initiate cationic polymerization include ionic polymerization initiators such as $B(C_6F_5)_4^-$, $PF_6^-$, $AsF_6^-$, $SbF_6^-$, and $CF_3SO_3^-$ salt of aromatic onium compounds such as diazonium, ammonium, iodonium, sulfonium and phosphonium, and nonionic polymerization initiators such as sulfonate which generates a sulfonic acid, halide which generates hydrogen halide, an iron allene complex or the like. Sulfonate which generates a sulfonic acid and a halide which generates hydrogen halide as the nonionic polymerization initiator are Specifically preferable.

The photopolymerization initiators preferably used are exemplified below.

Examples of α-Amino Acetophenone Based Compounds

Polymerization initiator 1-1

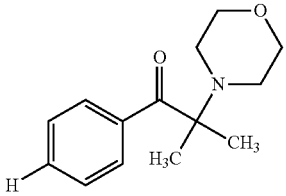

-continued

Polymerization initiator 1-2

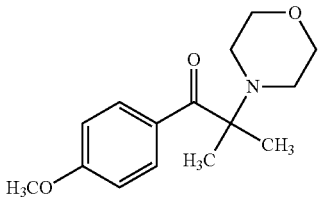

Polymerization initiator 1-3

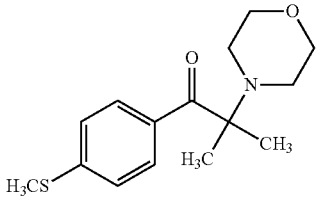

Polymerization initiator 1-4

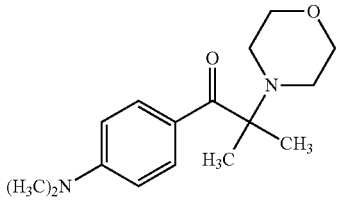

Polymerization initiator 1-5

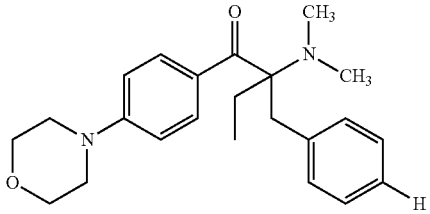

Polymerization initiator 1-6

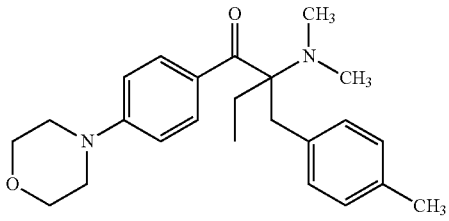

Examples of α-Hydroxyacetophenone Based Compounds

Polymerization initiator 2-1

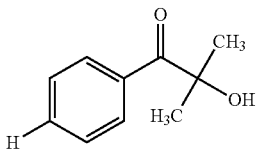

-continued

Polymerization initiator 2-2

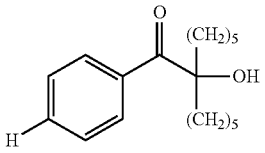

Polymerization initiator 2-3

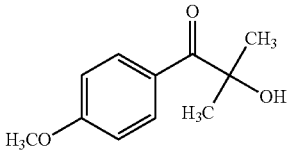

Polymerization initiator 2-4

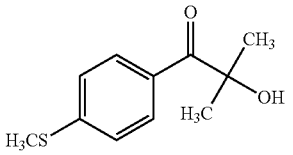

Polymerization initiator 2-5

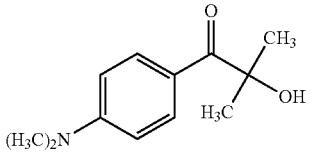

Polymerization initiator 2-6

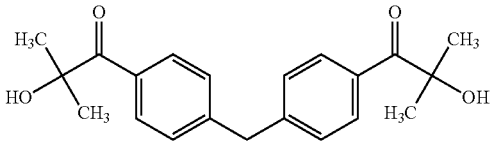

Examples of acylphosphine oxide based compounds

Polymerization initiator 3-1

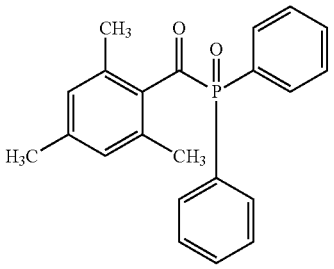

Polymerization initiator 3-2

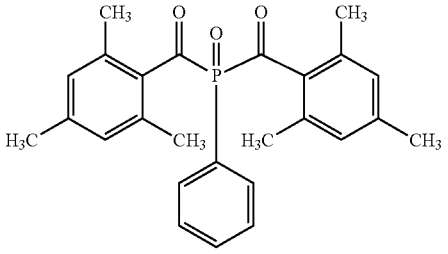

Examples of Other Radical Polymerization Initiators

Polymerization initiator 4-1

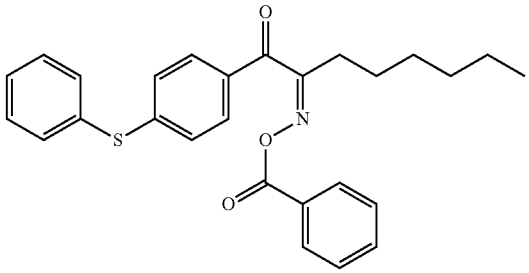

Polymerization initiator 4-2

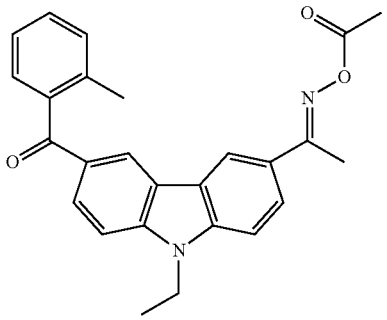

Polymerization initiator 4-3

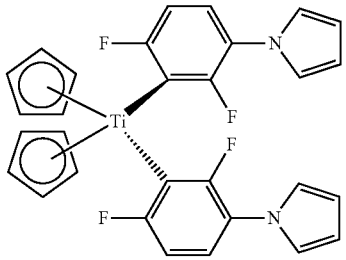

Polymerization initiator 5-1

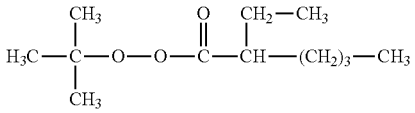

Nonionic polymerization inititators

Polymerization initiator 6-1

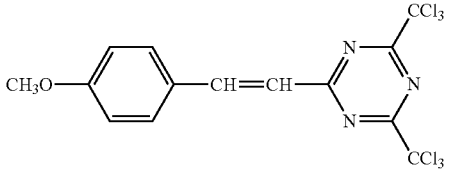

Polymerization initiator 6-2

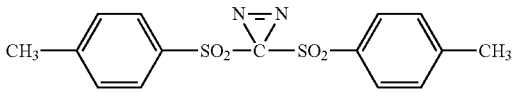

-continued

Polymerization initiator 6-3

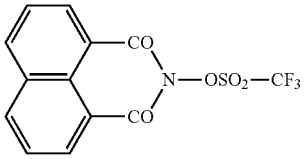

Polymerization initiator 6-4

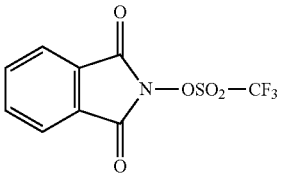

Polymerization initiator 6-5

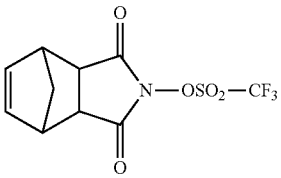

Polymerization initiator 6-6

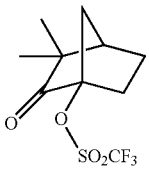

Ionic polymerization initiators

Polymerization initiator 7-1

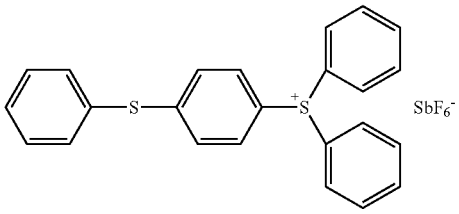

Polymerization initiator 7-2

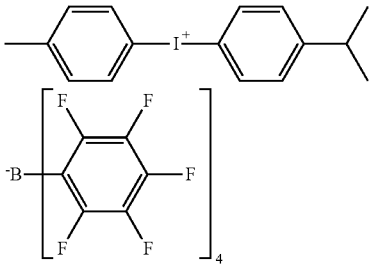

In order to form a protective layer, preferable is a method by which a coating solution of a protective layer (the above-described composition) is coated on a photosensitive layer, followed by primarily drying to such an extent that the coating film has no fluidity, and the resulting is subsequently exposed to UV radiation to cure the protective layer, further followed by secondarily drying in such a way that an amount of volatile substances in the coating film reaches a specified amount to prepare the protective layer.

As a UV exposure apparatus, usable is a commonly known apparatus employed for curing a UV-curable resin.

Quantity of UV radiation to UV-cure the coating solution having been coated (mJ/cm$^2$) is preferably controlled by UV exposure intensity and exposure time.

On the other hand, a ketone peroxide based compound, a par oxyketal based compound, a hydro peroxide based compound, a dialkyl peroxide based compound, a diacyl peroxide based compound, a peroxy dicarbonate based compound and a peroxy ester based compound and so forth are employed as the thermal polymerization initiator, and these thermal polymerization initiators are disclosed in a product brochure or the like of the company.

In the present invention, the thermal polymerization initiator is mixed with alumina particles or a curable compound having a reactive organic group similarly to the foregoing photopolymerization initiator to prepare a protective layer coating solution, and the coating solution is coated on a photosensitive layer, followed by drying while heating to form a protective layer of the present invention. As the thermal polymerization initiator, the foregoing radical polymerization initiators and others are usable.

Further, as a method of coating a coating solution for a protective layer, a coat-processing method such as an amount controlling type coating method (a circular slide hopper type coating method) or the like is preferably employed in view of inhibition of dissolving a film as a photosensitive layer. The foregoing circular amount controlling type coating method is detailed in Japanese Patent O.P.I. Publication No. 58-189061.

These polymerization initiators may be used singly or as a mixture of at least two kinds. A polymerization initiator has a content of 0.1-20 parts by weight with respect to 100 parts by weight of an acrylic compound, and preferably has a content of 0.5-10 parts by weight.

Further, the protective layer of the present invention may contain various kinds of charge transport materials.

Various kinds of lubricant particles can be added to the protective layer in the present invention. For example, fluorine atom-containing resin particles can be added. For the fluorine atom-containing resin particles, an ethylene tetrafluoride resin, an ethylene trifluoride resin, an ethylene hexafluoride propylene resin, a vinyl fluoride resin, a vinylidene fluoride resin and an ethylene difluoride dichloro resin are provided, and at least one kind should be selected from these copolymers, but an ethylene tetrafluoride resin and a vinylidene fluoride resin are specifically preferable. The amount of the lubricant particles in the protective layer is preferably 5-70 parts by weight with respect to 100 parts by weight of the acrylic resin, and more preferably 10-60% by weight. The preferred particle diameter of the lubricant particles is preferably one such as an average primary particle diameter of 0.01-1 μm. The specifically preferred average primary particle diameter is 0.05-0.5 μm. There is no particular restriction to the molecular weight of the resin, and the molecular weight of the resin can be appropriately selected.

Examples of solvents to form the protective layer include methanol, ethanol, n-propyl alcohol, isopropyl alcohol, n-butanol, t-butanol, sec-butanol, benzyl alcohol, toluene, xylene, methylene chloride, methyl ethyl ketone, cyclohexane, ethyl acetate, butyl acetate, methyl cellosolve, ethyl cellosolve, tetrahydrofuran, 1-dioxane, 1,3-dioxolane, pyridine, diethyl amine and so forth, but the present invention is not limited to these solvents.

After the protective layer of the present invention, having been subjected to coating is dried by naturally drying or thermally drying, the protective layer is preferably exposed to actinic rays to produce reaction.

Examples of the coating method used similarly to the cases of an intermediate layer and a photosensitive layer include commonly known methods such as a dip coating method, a spray coating method, a spinner coating method, a bead coating method, a blade coating method, a beam coating method, a slide hopper coating method and so forth.

The protective layer of an organic photoreceptor of the present invention is preferably formed by exposing a coating layer to actinic rays to generate radicals for polymerization, and forming crosslinking bonds via crosslinking reaction among molecules and within the molecule for curing to produce a curing resin. As the actinic rays, UV radiation and electron beams are specifically preferable.

As a UV radiation source is usable with no limitation, as long as a light source generates UV radiation. Usable examples thereof include a low pressure mercury lamp, an intermediate pressure mercury lamp, a high pressure mercury vapor lamp, an ultrahigh pressure mercury lamp, a carbon arc lamp, a metal halide lamp, a xenon lamp, a flash (pulse) xenon and so forth. An exposure condition may change depending on each of the lamps, but an exposure amount of actinic rays is conventionally 5-500 $mJ/cm^2$, and preferably 5-100 $mJ/cm^2$. The lamp preferably has an electric power of 0.1-5 kW, and more preferably has an electric power of 0.5-3 kW.

As an electron beam source, an electron beam exposure apparatus is not specifically limited. Conventionally, as an electron beam accelerator for such electron beam exposure, a curtain beam system capable of obtaining high power at relatively low cost is effectively employed. An accelerating voltage during electron beam exposure is preferably 100-300 kV. An absorbing dose is preferably 0.5-10 Mrad.

An exposure time to obtain a desired amount of actinic rays is preferably 0.1 sec to 10 minutes, and more preferably 0.1 sec to 5 minutes in view of workability. As actinic rays, UV radiation is specifically preferable since it is easy to be used.

The organic photoreceptor of the present invention can be subjected to drying before or after exposure to actinic rays, or drying during exposure to actinic rays, and timing for drying can be appropriately selected by using the above-described in combination.

The drying condition can be appropriately selected depending on kinds of solvents, and layer thickness and so forth. A drying temperature is preferably room temperature to 180° C., and more preferably 80-140° C. A drying duration is preferably 1 minute to 200 minutes, and more preferably 5-100 minutes.

The protective layer preferably has a layer thickness of 0.2-10 μm, and more preferably has a layer thickness of 0.5-6 μm.

[Conductive Support]

The support used in the present invention may be any support as long as it exhibits conductivity. Examples thereof include a drum or a molded sheet formed of a metal such as aluminum, copper, chromium, nickel, zinc stainless steel or the like; one in which metal foils made of aluminum or copper are laminated on a plastic film; one in which aluminum, indium oxide or tin oxide is evaporated on a plastic film; and a metal, a plastic film, or a paper sheet on which a conductive layer is provided by coating a conductive material singly or with a binder resin.

[Intermediate Layer]

In the present invention, an intermediate layer having a barrier function and an adhesion function can be provided between a conductive layer and a photosensitive layer.

The intermediate layer can be formed via dip coating or the like by dissolving a binder resin such as casein, polyvinyl alcohol, nitrocellulose, an ethylene acrylic acid copolymer, polyamide, polyurethane or gelatin in a commonly known solvent. Of these, an alcohol soluble polyamide resin is preferable.

Various kinds of conductive particles and metal oxides each can be contained for the purpose of adjusting resistance of the intermediate layer. Examples thereof include various metal oxides such as aluminum, zinc oxide, titanium oxide, tin oxide, antimony oxide, indium oxide, bismuth oxide and so forth. Ultrafine particles formed of indium oxide in which tin is doped, tin oxide or zirconium oxide in which antimony is doped, or the like are usable.

These metal oxides may be used singly or as a mixture in combination with at least two kinds. When at least two kinds are mixed, configuration of solid solution or fusion may be taken. Such a metal oxide preferably has an average particle diameter of 0.3 μm or less, and more preferably has an average particle diameter of 0.1 μm or less.

A solvent used in an intermediate layer is preferably one capable of effectively dispersing inorganic particles and dissolving a polyamide resin. Specifically, alcohols having 2-4 carbon atoms, such as ethanol, n-propyl alcohol, isopropyl alcohol, n-butanol, t-butanol and sec-butanol are preferable in view of solubility and coatability of a polyamide resin. Further, in order to improve a storage property and dispersibility of particles, an auxiliary solvent may be used in combination with the foregoing solvent. Examples of the auxiliary solvent capable of obtaining excellent effects include methanol, benzyl alcohol, toluene, methylene chloride, cyclohexane, tetrahydrofuran and so forth.

The density of a binder resin is appropriately selected depending on layer thickness of an intermediate layer and a manufacturing speed.

As a mixture ratio of inorganic particles to a binder resin during dispersion of the inorganic particles, 20-400 parts by weight of the inorganic particles with respect to 100 parts by weight of the binder resin are preferable, and 50-200 parts by weight of the inorganic particles with respect to 100 parts by weight of the binder resin are more preferable.

As a means to disperse inorganic particles, an ultrasonic homogenizer, a ball mill, a sand grinder and a homogenizing mixer are usable, but the present invention is not limited thereto.

A method of drying the intermediate layer can be appropriately selected depending on kinds of solvents and layer thickness, but thermal drying is preferable.

The intermediate layer preferably has a layer thickness of 0.1-15 μm, and more preferably has a layer thickness of 0.3-10 μm.

[Charge Generation Layer]

The photosensitive layer of the present invention is preferably composed of at least two layers of a charge generation layer and a charge transport layer.

A charge generation layer used in the present invention contains a charge generation material and a binder resin, and is preferably formed by dispersing the charge generation material in a binder resin solution, followed by coating.

Examples of the charge generation material include azo materials such as Sudan Red and Diane Blue; quinone pigments such as pilene quinone and anthoanthrone; quinocyanine pigments; perylene pigments; indigo pigments such as indigo and thioindigo; and phthalocyanine pigments, but the present invention is not limited thereto. These charge generation materials can be used singly or in the form of a dispersion in which materials are dispersed in a commonly known resin.

As a binder resin for the charge generation layer, a commonly known resin is usable. Examples thereof include a polystyrene resin, a polyethylene resin, a polypropylene resin, an acrylic resin, a methacrylic resin, a vinyl chloride resin, a vinyl acetate resin, a polyvinyl butyral resin, an epoxy resin, a polyurethane resin, a phenol resin, a polyester resin, an alkyd resin, a polycarbonate resin, a silicone resin, a melamine resin, a copolymer resin containing at least two of these resins (e.g., a vinyl chloride-vinyl acetate copolymer resin, and a vinyl chloride-vinyl acetate-anhydrous maleic acid copolymer resin), a polyvinyl carbazole resin, and so forth, but the present invention is not limited thereto.

As to formation of a charge generation layer, it is preferred that a charge generation material is dispersed in a solution in which a binder resin is dissolved in a solvent employing a dispersing apparatus to prepare a coating solution, the coating solution is coated with a coater so as to give a predetermined thickness, and the coating film is dried to prepare the charge generation layer.

Examples of the solvent for coating after dissolving a binder resin, which is used for the charge generation layer, include toluene, xylene, methylene chloride, 1,2-dichloroethane, methyl ethyl ketone, cyclohexane, ethyl acetate, butyl acetate, methanol, ethanol, propanol, butanol, methyl cellosolve, ethyl cellosolve, tetrahydrazine, 1-dioxane, 1,3-dioxolane, pyridine and diethyl amine, but the present invention is not limited thereto.

Usable examples of a dispersing means for the charge generation material include an ultrasonic homogenizer, a ball mill, a sand grinder, a homogenizing mixer and so forth, but the present invention is not limited thereto.

The mixing ratio of the charge generation material to the binder resin is preferably 1-600 parts by weight with respect to 100 parts by weight of the binder resin, and more preferably 50-500 parts by weight. The layer thickness of the charge generation layer differs depending on properties of the charge generation material, properties of the binder resin, and a mixing ratio thereof, but is preferably 0.01-5 μm, and more preferably 0.05-3 μm. In addition, generation of image defects can be inhibited by filtering foreign matter and aggregates before coating a coating solution for the charge generation layer. The charge generation layer can also be formed via vacuum evaporation of the foregoing pigment.

[Charge Transport Layer]

A charge transport layer used in a photosensitive layer of the present invention contains a charge transport material and a binder resin, and is formed via coating after dissolving the charge transport material in a binder resin solution.

Examples of the charge transport material include a carbazole derivative, an oxazole derivative, an oxadiazole derivative, a thiazole derivative, a thiadizole derivative, a triazole derivative, an imidazole derivative, an imidazolone derivative, an imidazolidine derivative, a bisimidazolidine derivative, a styryl compound, a hydrazone compound, a pyrazoline compound, an oxazolone derivative, a benzoimidazole derivative, a quinazoline derivative, a benzofuran derivative, an acridine derivative, a phenazine derivative, an aminostilbene derivative, a triaryl amine derivative, a phenylene diamine derivative, a stilbene derivative, a benzidine derivative, poly-N-vinyl carbazole, poly-1-vinyl pyrene and poly-9-vinyl anthracene, and these may be used by mixing at least two kinds.

As charge transport material (CTM), a charge transport material having an atomic weight ratio of N atom of less than 4.5% is preferably used. As a basic structure of the charge transport material, a triphenylamine derivative, a styryl compound, a benzidine compound, or a butadiene compound may be used. Of these, a styryl compound is preferable.

A commonly known resin can be used as a binder resin for the charge transport layer, and examples thereof include a polycarbonate resin, a polyacrylate resin, a polyester resin, a polystyrene resin, a styrene-acrylnitryl copolymer resin, a polymethacrylic acid ester resin, and a styrene-methacrylic acid ester copolymer resin, but polycarbonate is preferable. Further, BPA, BPZ, dimethyl BPA, and a BPA-dimethyl BPA copolymer are preferable in view of crack resistance, wear resistance, and an electrification property.

As to formation of a charge transport layer, it is preferred that a binder resin and a charge transport material are dissolved to prepare a coating solution; the coating solution is coated with a coater so as to give the predetermined layer thickness; and the coating film is dried to prepare charge transport layer Examples of the solvent to dissolve the binder resin and the charge transport material include toluene, xylene, methylene chloride, 1,2-dichloroethane, methyl ethyl ketone, cyclohexane, ethyl acetate, butyl acetate, methanol, ethanol, propanol, butanol, tetrahydrofuran, 1,4-dioxane, 1,3-dioxolane, pyridine and diethyl amine, but the present invention is not limited thereto.

The mixing ratio of the charge transport material to the binder resin is preferably 10-500 parts by weight of the charge transport material with respect to 100 parts by weight of the binder resin, and more preferably 20-100 parts by weight of the charge transport material.

The layer thickness of the charge transport layer differs depending on properties of the charge transport material, properties and a mixing ratio of the binder resin, but it is preferably 5-40 μm, and more preferably 10-30 μm.

An antioxidant, an electronic conductive agent and a stabilizer may be added into the charge transport layer. Antioxidants disclosed in Japanese Patent Application No. 11-200135 may be used, and electronic conductive agents disclosed in Japanese Patent O.P.I. Publication No. 50-137543 and Japanese Patent O.P.I. Publication No. 58-76483 may be used.

Next, an image forming apparatus employing an organic photoreceptor of the present invention will be described.

Image forming apparatus 1 shown in FIG. 1 is a digital system image forming apparatus. It possesses image reading section A, image processing section B, image forming section C, and transfer paper conveyance section D as a transfer paper conveyance device.

An automatic document feeding device for automatically feeding documents is arranged on the top of image reading section A. The documents placed on document platen 11 as conveyed sheet by sheet employing document conveying roller 12, and the image is read at reading position 13*a*. The document having been read is ejected onto document ejection tray 14 by document conveying roller 12.

In the meantime, the image of the document placed on platen glass 13 is read by reading operation at speed v by first mirror unit 15 having an illumination lamp constituting a scanning optical system and a first mirror, and by the movement of second mirror unit 16 having the second and third mirrors located at the V-shaped position at a speed of v/2 in the same direction.

The scanned images are formed on the light receiving surface of image-capturing device (CCD) as a line sensor through projection lens 17. The linear optical images formed on image-capturing device (CCD) are sequentially subjected to photoelectric conversion into electric signals (luminance signals). Then they are subjected to A/D conversion, and then to such processing as density conversion and filtering in image processing section B. Image data are subsequently stored once in the memory.

Image forming section C as an image forming unit possesses drum-formed photoreceptor 21 as an image carrier; charging device (charging process) 22 for charging photoreceptor 21 on the outer periphery; potential detecting device 220 for detecting the potential on the surface of the charged photoreceptor; developing device (developing process) 23; transfer conveyance belt apparatus 45 as a transfer section (transfer process); cleaning device (cleaning process) 26 for photoreceptor 21; and PCL (pre-charge lamp) 27 as an optical discharging section (optical discharging process). These components are arranged in the order of operations. Further, reflected density detecting section 222 for measuring the reflected density of the patch image developed on photoreceptor 21 is provided downstream from developing device 23. A photoreceptor of the present invention is used as photoreceptor 21, and is driven in the clockwise direction as illustrated.

Rotating photoreceptor 21 is electrically charged uniformly by charging device 22. After that, image exposure is performed based on the image signal called up from the memory of image processing section B by the exposure optical system as image exposure section (image exposure process) 30. In the exposure optical system as image exposure section 30 (also known as writing section), the optical path is bent by reflection mirror 32 through rotating polygon mirror 31, fθ lens 34, and cylindrical lens 35, using the laser diode (not illustrated) as a light emitting source, whereby main scanning is performed. Exposure is carried out at position Ao with reference to photoreceptor 21, and an electrostatic latent image is formed by the rotation (sub-scanning) of photoreceptor 21.

In an image forming apparatus of the present invention, when an electrostatic latent image is formed on a photoreceptor, a semiconductor laser or a light-emitting diode having an oscillation wavelength of 350-500 nm is used as an image exposure light source. Using such an image exposure light source, a light exposure dot diameter in the primary scanning direction of writing is narrowed to 10-100 μm, and digital light exposure is conducted on an organic photoreceptor to obtain an electrophotographic image at a high resolution of 400-2500 dpi (dpi: the number of dots per 2.54 cm).

The foregoing light exposure dot diameter means a length of the exposure beam along with the main scanning direction in the area where the intensity of this exposure beam corresponds to $1/e^2$ of the peak light intensity (Ld: measured at the maximum length position).

The light beam to be used includes the beams of the scanning optical system using the semiconductor laser, solid scanner such as an LED and so forth. The distribution of the light intensity includes Gauss distribution and Lorenz distribution. The portion exceeding $1/e^2$ of each peak intensity is assumed as a light exposure dot diameter of the present invention.

The electrostatic latent image on photoreceptor 21 is subject to reverse development by developing device 23, and a visible toner image is formed on the surface of photoreceptor 21. According to the image forming method of the present invention, polymerized toner is utilized as the developer for this developing device. An electrophotographic image exhibiting excellent sharpness can be achieved when the polymerized toner having a uniform shape and particle size is used in combination with the photoreceptor of the present invention.

The electrostatic latent image formed on the photoreceptor of the present invention is visualized as a toner image via development. The toner to be used for the development may be crushed toner or polymerized toner, but the toner of the present invention is preferably a polymerized toner prepared by a polymerization method from the viewpoint of realization of a stable particle size distribution.

The polymerized toner means a toner formed via preparation of a binder resin for the toner, polymerization of a raw material monomer for the binder resin to be of toner shape, and a subsequent chemical treatment, if desired. To be more concrete, the foregoing toner means a toner formed via polymerization reaction such as suspension polymerization, emulsion polymerization or the like, and a particle-to-particle fusing process subsequently carried out, if desired.

In addition, the volume average particle diameter, that is, 50% volume particle diameter (Dv50) is preferably 2-9 μm, and more preferably 3-7 μm. High resolution can be obtained by falling the volume average particle diameter in this range. Further, an existing amount of toner having a fine particle diameter can be reduced in combination with the above-described range, though the toner is one having a small particle diameter, whereby improved dot image reproduction is obtained for a long duration, and stable images exhibiting excellent sensitivity can be formed.

The toner of the present invention may be used as a single component developer or a two-component developer.

When the toner is used as a single component developer, provided is a nonmagnetic single component developer, or a magnetic single component developer containing magnetic particles of approximately 0.1-0.5 μm in size in the toner, and both the nonmagnetic single component developer and the magnetic single component developer are usable.

The toner may be used as a two-component developer by mixing with a carrier. In this case, commonly known materials which are metal such as iron, ferrite, magnetite or the like, an alloy of such the metal and another metal such as aluminum, lead or the like, and so forth are usable as magnetic particles for carrier. Ferrite is specifically preferred. The above-described magnetic particles may preferably have a volume average particle diameter of 15-100 μm, and more preferably have a volume average particle diameter of 25-80 μm.

The volume average particle diameter of carrier can be measured typically by a laser diffraction particle size distribution measuring apparatus equipped with a wet type disperser (HELOS, manufactured by SYMPATEC Corp.).

The carrier is preferably a carrier in which a magnetic particle is coated with a resin, or a so-called resin dispersion type carrier in which a magnetic particle is dispersed in a resin. The resin composition for coating is not specifically limited, but usable examples thereof include an olefin based resin, a styrene based resin, a styrene-acryl based resin, a silicone based resin, an ester based resin, a fluorine-containing polymer based resin and so forth. The resin to prepare the resin dispersion type carrier is not specifically limited, but commonly known resins are usable. Examples thereof include a styrene-acrylic resin, a polyester resin, a fluorine based resin, a phenol resin and so forth.

In transfer paper conveyance section D, sheet feed units 41(A), 41(B) and 41(C) as a transfer sheet storage device are arranged below the image forming unit, wherein transfer sheets P having different sizes are stored. A manual sheet feed unit 42 for manual feed of the sheets of paper is provided on the side. Transfer sheets P selected by either of the two are fed along sheet conveyance path 40 by guide roller 43, and are temporarily suspended by sheet feed registration roller 44 for correcting the inclination and deviation of transfer sheets P. Then transfer sheets P are again fed and guided by sheet conveyance path 40, pre-transfer roller 43*a*, paper feed path 46 and entry guide plate 47. The toner image on photoreceptor 21 is transferred to transfer sheet P at transfer position Bo while placing and conveying it onto transfer conveyance belt 454 of transfer conveyance belt apparatus 45 transfer electrode 24 and separator electrode 25, and transfer sheet P is also separated from the photoreceptor. Then, transfer sheet P is separated from the surface of photoreceptor 21, and conveyed to fixing device 50 by transfer conveyance belt apparatus 45.

Fixing device 50 is equipped with fixing roller 51 and pressure roller 52. When transfer sheet P passes between fixing roller 51 and pressure roller 52, toner is fixed in position by heat and pressure. With the toner image having been fixed thereon, transfer sheet P is ejected onto ejection tray 64.

The above description indicates the case where an image is formed on one side of the transfer sheet. In the case of duplex copying, paper sheet ejection switching member 170 is switched and transfer sheet guide 177 is opened. Transfer sheet P is fed in the direction of an arrow shown in a broken line.

Further, transfer sheet P is fed downward by conveyance device 178 and is switched back by sheet reversing section 179. With the trailing edge of transfer sheet P becoming the leading edge, transfer sheet P is conveyed into sheet feed unit 130 for duplex copying.

Conveyance guide 131 provided on sheet feed unit 130 for duplex copying is moved in the direction of sheet feed by transfer sheet P. Then transfer sheet P is fed again by sheet feed roller 132 and is led to sheet conveyance path 40.

As described above, transfer sheet P is fed in the direction of photoreceptor 21 again, and the toner image is transferred on the reverse side of transfer sheet P. After the image has been fixed by fixing section 50, transfer sheet P is ejected to ejection tray 64.

The image forming apparatus of the present invention can be configured in such a way that the components such as the foregoing photoreceptor, developing device, cleaning device and so forth are integrally combined to a process cartridge, and this unit may be installed in the apparatus main body as a detachable unit. It is also possible to arrange such a configuration that at least one of the charging device, the imagewise light exposure device, the developing device, the transfer or separation electrode and the cleaning device is integrally supported with the photoreceptor to form a process cartridge as a single detachable unit capable of being installed in the apparatus main body, employing a guide device such as a rail of the apparatus main body.

Figure 2:
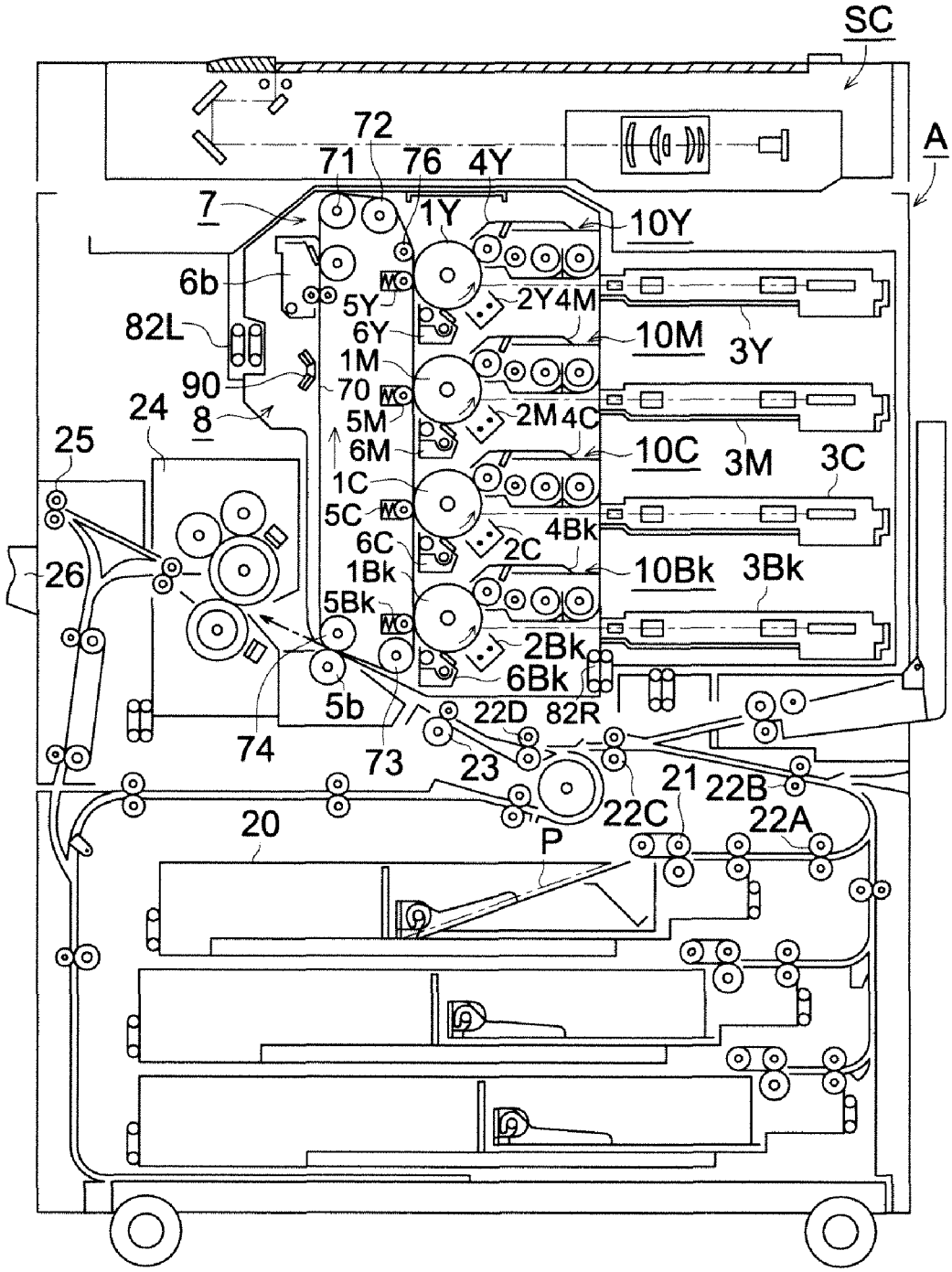
FIG. 2 is a cross-sectional diagram of a color image forming apparatus in an embodiment of the present invention.

FIG. 2 is a cross-sectional diagram of a color image forming apparatus in an embodiment of the present invention.

This color image forming apparatus is called the so-called tandem type color image forming apparatus, and comprises four sets of image forming sections (image forming units) 10Y, 10M, 10C, and 10Bk, endless belt shaped intermediate transfer member unit 7, sheet feeding and conveyance device 21, and fixing device 24. The original document reading apparatus SC is placed on top of main unit A of the image forming apparatus.

Image forming section 10Y that forms images of yellow color comprises charging device (charging process) 2Y, light exposure device (light exposure process) 3Y, developing device (developing process) 4Y, primary transfer roller 5Y as primary transfer section (primary transfer process), and cleaning device 6Y all placed around drum-formed photoreceptor 1Y which acts as the first image supporting body. Image forming section 10M that forms images of magenta color comprises drum-formed photoreceptor 1M which acts as the first image supporting body, charging device 2M, light exposure device 3M, developing device 4M, primary transfer roller 5M as a primary transfer section, and cleaning device 6M. Image forming section 10C that forms images of cyan color comprises drum-formed photoreceptor 1C which acts as the first image supporting body, charging device 2C, light exposure device 3C, developing device 4C, primary transfer roller 5C as a primary transfer section, and cleaning device 6C. Image forming section 10Bk that forms images of black color comprises drum-formed photoreceptor 1Bk which acts as the first image supporting body, charging device 2Bk, light exposure device 3Bk, developing device 4Bk, primary transfer roller 5Bk as a primary transfer section, and cleaning device 6Bk.

Four sets of image forming units 10Y, 10M, 10C, and 10Bk are constituted, centering on photoreceptor drums 1Y, 1M, 1C, and 1Bk, by rotating charging devices 2Y, 2M, 2C, and 2Bk, image wise light exposure devices 3Y, 3M, 3C, and 3Bk, rotating developing devices 4Y, 4M, 4C, and 4Bk, and cleaning devices 5Y, 5M, 5C, and 5Bk that clean photoreceptor drums 1Y, 1M, 1C, and 1Bk.

Image forming units 10Y, 10M, 10C, and 10Bk, all have the same configuration excepting that the color of the toner image formed in each unit is different on respective photoreceptor drums 1Y, 1M, 1C, and 1Bk, and detailed description is given below taking the example of image forming unit 10Y.

Image forming unit 10Y has, placed around photoreceptor drum 1Y which is the image forming body, charging device 2Y (hereinafter referred to merely as charging unit 2Y or charger 2Y), light exposure device 3Y, developing device 4Y, and cleaning device 5Y (hereinafter referred to simply as cleaning device 5Y or as cleaning blade 5Y), and forms yellow (Y) colored toner image on photoreceptor drum 1Y. Further, in the present preferred embodiment, at least photoreceptor drum 1Y, charging device 2Y, developing device 4Y, and cleaning device 5Y in image forming unit 10Y are provided in an integral manner.

Charging device 2Y is a device that applies a uniform electrostatic potential to photoreceptor drum 1Y, and corona discharge type charger 2Y is being used for photoreceptor drum 1Y in the present preferred embodiment.

Imagewise light exposure device 3Y is a device that conducts light exposure, based on an image signal (Yellow), and forms an electrostatic latent image corresponding to the yellow color image. This light exposure device 3Y is one composed of LED arranged in the form of an array in the direction of photoreceptor drum 1Y axis, and an image focusing element (product name: Selfoc lens), or is a laser optical system.

The image forming apparatus of the present invention may be configured in such a way that the constituents such as the foregoing photoreceptor, a developing device, a cleaning device and so forth are integrally combined to a process cartridge (image forming unit), and this image forming unit may be installed in the apparatus main body as a detachable unit. It is also possible to arrange such a configuration that at least one of the charging device, the imagewise light exposure device, the developing device, the transfer or separation device and the cleaning device is integrally supported with the photoreceptor to form a process cartridge (image forming unit) as a single detachable image forming unit, employing a guide device such as a rail of the apparatus main body. Herein, "integrally supported" means that a block as a process cartridge unit can be installed or removed when the process cartridge is installed or removed.

Intermediate transfer member unit 7 in the form of an endless belt is wound around a plurality of rollers, and has endless belt shaped intermediate transfer member 70 which acts as a second image carrier in the shape of a partially conducting endless belt which is supported in a free manner to rotate.

The images of different colors formed by image forming units 10Y, 10M, 10C, and 10Bk, are successively transferred on to rotating endless belt shaped intermediate transfer member 70 by primary transfer rollers 5Y, 5M, 5C, and 5Bk acting as the primary image transfer section, thereby forming the synthesized color image. Transfer material P as the transfer material stored inside sheet feeding cassette 20 (the supporting body that carries the final fixed image: for example, plain paper, transparent sheet, etc.,) is fed from sheet feeding device 21, pass through a plurality of intermediate rollers 22A, 22B, 22C, and 22D, and resist roller 23, and is transported to secondary transfer roller 5*b* which functions as the secondary image transfer section, and the color image is transferred in one operation of secondary image transfer on to transfer material P. Transfer material P on which the color image has been transferred is subjected to fixing process by fixing device 24, and is gripped by sheet discharge rollers 25 and placed above sheet discharge tray 26 outside the equipment. Here, the transfer supporting body of the toner image formed on the photoreceptor of the intermediate transfer body or of the transfer material, etc. is collectively called a transfer medium.

On the other hand, after the color image is transferred to transfer material P by secondary transfer roller 5*b* functioning as the secondary transfer section, endless belt shaped intermediate transfer member 70 from which transfer material P has been separated due to different radii of curvature is cleaned by cleaning device 6*b* to remove the remaining toner.

During image forming, primary transfer roller 5Bk is at all times contacting against photoreceptor 1Bk. Other primary transfer rollers 5Y, 5M, and 5C come into contact with photoreceptors 1Y, 1M, and 1C, respectively, only during color image forming.

Secondary transfer roller 5*b* comes into contact with endless belt shaped intermediate transfer body 70 only when secondary transfer is conducted with transfer material P passing through this.

Further, chassis 8 can be pulled out via supporting rails 82L and 82R from body A of the apparatus.

Chassis 8 possesses image forming sections 10Y, 10M, 10C, and 10Bk, and endless belt shaped intermediate transfer member unit 7.

Image forming sections 10Y, 10M, 10C, and 10Bk are arranged in column in the vertical direction. Endless belt shaped intermediate transfer member unit 7 is placed to the left side in the figure of photoreceptor drums 1Y, 1M, 1C, and 1Bk. Endless belt shaped intermediate transfer member unit 70 possesses endless belt shaped intermediate transfer member 70 that can rotate around rollers 71, 72, 73, and 74, primary image transfer rollers 5Y, 5M, 5C, and 5Bk, and cleaning device 6*b*.

Figure 3:
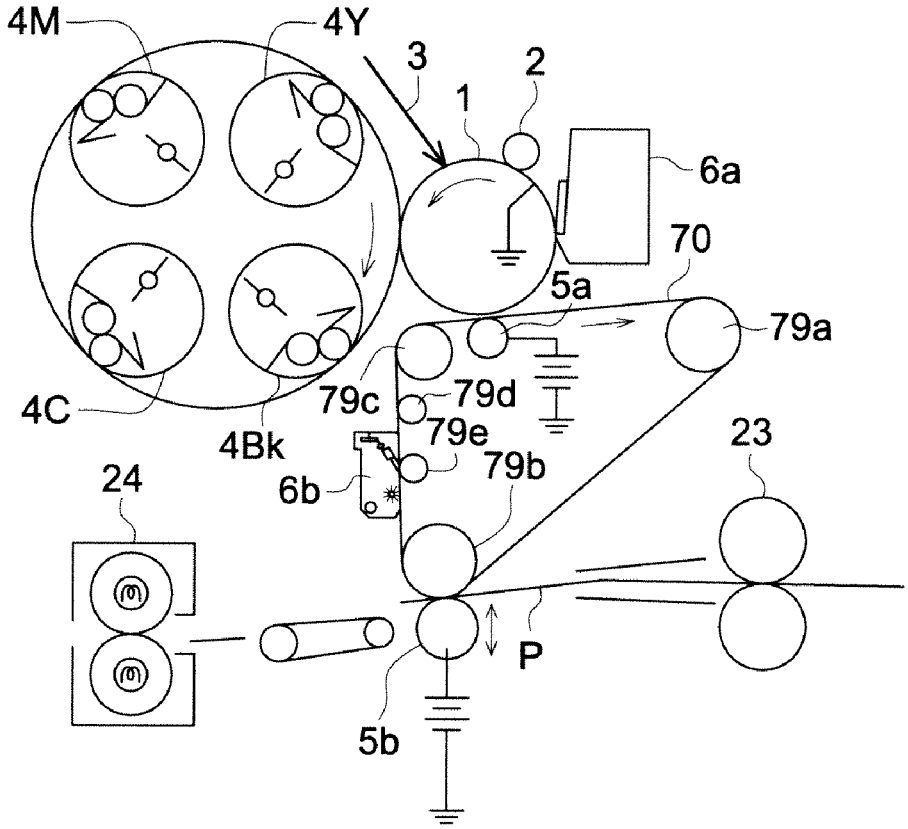
FIG. 3 is a schematic cross-sectional view of a color image forming apparatus possessing an organic photoreceptor of the present invention.

Next, FIG. 3 is a cross-sectional view of a color image forming apparatus possessing an organic photoreceptor of the present invention (a copier or a laser beam printer possessing at least a charging device, a light exposure device, a plurality of developing devices, an image transfer device, a cleaning device, and an intermediate transfer member provided around the organic photoreceptor). An elastic body with a medium level of electrical resistivity is employed for belt shaped intermediate transfer member 70.

Numeral 1 represents a rotating drum type photoreceptor that is repetitively used as the image carrying body, and is driven to rotate with a specific circumferential velocity in the anticlockwise direction indicated by the arrow.

During rotation, photoreceptor 1 is evenly charged to a specific polarity and potential by charging device (charging process) 2, and next, when it receives image exposure obtained via scanning exposure light with a laser beam modulated in accordance with the time-serial electrical digital pixel signal of the image information from imagewise light exposure device (imagewise light exposure process) 3 not shown in the figure, formed is an electrostatic latent image corresponding to yellow (Y) color component image (color information) as an intended color image.

Next, the electrostatic latent image is developed by yellow (Y) developing device: developing process (yellow color developing device) 4Y employing the yellow toner as the first color. In this case, the second developing device to the fourth developing device (magenta color developing device, cyan color developing device, and black color developing device) 4M, 4C, and 4Bk each are in the operation switched-off state and do not act on photoreceptor 1, and the yellow toner image of the above-described first color does not get affected by the above-described second developing device to fourth developing device.

Intermediate transfer member 70 is passed through rollers 79*a*, 79*b*, 79*c*, 79*d*, and 79*e* and is driven to rotate in the clockwise direction with the same circumferential speed as that of photoreceptor 1.

The yellow toner image of the first color formed and retained on photoreceptor 1 is, in the process of passing through the nip section between photoreceptor 1 and intermediate transfer member 70, intermediate-transferred (primary transferred) successively to the outer peripheral surface of intermediate transfer member 70 due to the electric field formed by the primary transfer bias voltage applied from primary transfer roller 5*a* to intermediate transfer member 70.

The surface of photoreceptor 1 after it has completed the transfer of the first color yellow toner image to intermediate transfer member 70 is cleaned by cleaning device 6*a*.

In the same manner as described above, the second color magenta toner image, the third color cyan toner image, and the fourth color black toner image are transferred successively on to intermediate transfer member 70 in a superimposing manner, thereby forming the superimposed color toner image corresponding to the intended color image.

Secondary transfer roller 5*b* is placed so that it is supported by bearings parallel to secondary transfer opposing roller 79*b* and pushes against intermediate transfer member 70 from below in a separable condition.

In order to carry out successive overlapping transfer of the toner images of the first to fourth colors from photoreceptor 1 to intermediate transfer member 70, the primary transfer bias voltage applied has a polarity opposite to that of the toner and is applied from the bias power supply. This applied voltage is, for example, in the range of +100 V to +2 kV.

During the primary transfer process of transferring the first to the third color toner image from photoreceptor 1 to intermediate transfer member 70, secondary transfer roller 5*b* and intermediate transfer member cleaning device 6*b* can be separated from intermediate transfer member 70.

The transfer of the superimposed color toner image transferred onto belt shaped intermediate transfer member 70 on to transfer material P which is the second image supporting body is done when secondary transfer roller 5*b* is in contact with the belt of intermediate transfer member 70, and transfer material P is fed from corresponding sheet feeding resist roller 23 via the transfer sheet guide to the contacting nip between secondary transfer roller 5*b* and intermediate transfer member 70 at a specific g. The secondary transfer bias voltage is applied from the bias power supply to secondary image transfer roller 5*b*. Because of this secondary transfer bias voltage, the superimposed color toner image is transferred (secondary transfer) from intermediate transfer member 70 to transfer material P which is the second image supporting body. Transfer material P which has received the transfer of the toner image is guided to fixing device 24 and is heated and fixed there.

The image forming apparatus of the present invention is commonly suitable for electrophotographic apparatuses such as electrophotographic copiers, laser printers, LED printers, liquid crystal shutter type printers and so forth. Further, the image forming apparatus can be widely utilized for apparatuses for displaying, recording, light printing, plate making and facsimile to which an electrophotographic technique is applied.

EXAMPLE

Next, the present invention will be described in detail referring to Examples, but embodiments of the present invention are not limited thereto. In addition, "parts" described below represent "parts by weight".

Preparation of Photoreceptor 1

Photoreceptor 1 is prepared as described below.

The surface of a cylindrical aluminum support was subjected to cutting processing to prepare a conductive support having a surface roughness Rz of 1.5 μm.

<Intermediate Layer>

An intermediate layer coating solution having the following composition was prepared.

| | |
|---|---|
| Polyamide resin X1010 (produced by Daicel-Degussa Ltd.) | 1 part |
| Titanium oxide SMT500SAS (produced by TAYCA Corporation) | 1.1 parts |
| Ethanol | 20 parts |

The composition was dispersed in a batch system employing a sand mill as a homogenizer for 10 hours.

The above-described coating solution was coated on the foregoing support by a dip coating method so as to give a dry thickness of 2 mm after drying at 110° C. for 20 minutes.

<Charge Generation Layer>

The following components were dispersed for ten hours employing a sand mill to prepare a charge generation layer coating solution. This coating solution was coated on an intermediate layer by a dip coating method to form a charge generation layer having a dry thickness of 0.3 μm.

| | |
|---|---|
| Charge generation material: Titanyl phthalocyanine pigment (a titanyl phthalocyanine pigment having at least a maximum diffraction peak at a position of 27.3° in a Cu—Kα characteristic X-ray diffraction spectrum measurement | 20 parts |
| Polyvinylbutyral resin (#6000-C, produced by Denkikagaku Kogyo Kabushiki Kaisha) | 10 parts |
| t-butyl acetate | 700 parts |
| 4-methoxy-4-methyl-2-pentanone | 300 parts |

<Charge Transport Layer>

The following components were mixed and dissolved to prepare a charge transport layer coating solution. This coating solution was coated on the foregoing charge generation layer by a dip coating method to form a charge transport layer having a dry thickness of 20 μm.

| | |
|---|---|
| Charge transport material: CTM (Compound A shown below) | 150 parts |
| Binder: Polycarbonate (Z300, produced by Mitsubishi Gas Chemical Company, Inc.) | 300 parts |
| Antioxidant (Irganox 1010, produced by Nihon Ciba Geigy K.K.) | 6 parts |
| Toluene/Tetrahydrofuran = 1/9 (in terms of % by volume) | 2000 parts |
| Silicone oil (KF-54, produced by Shin-Etsu Chemical Co., Ltd.) | 1 part |

Compound A

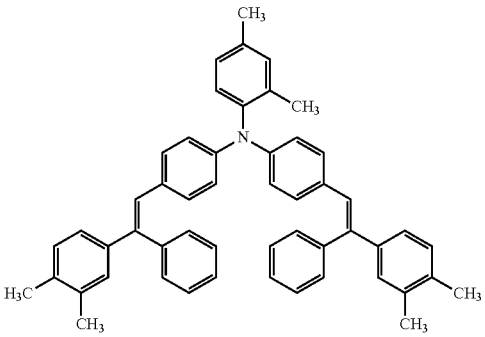

<Protective Layer>

| | |
|---|---|
| Alumina particles each having a reactive group {alumina particles having a number average primary particle diameter of 6 nm, having been subjected to a surface treatment with methacryloxypropyltrimethoxysilane (surface treatment agent) of the same weight as that of the alumina particles} | 100 parts |
| Curable compound (Exemplified compound No. 31) | 100 parts |
| Isopropyl alcohol | 500 parts |

After the above-described components were dispersed for ten hours employing a sand mill, 30 parts of polymerization initiator 1-6 were added, and mixed and dissolved while stirring under the light-shielding condition to prepare a protective layer coating solution (light shielded during storage). A protective layer was coated with the coating solution on a photoreceptor for which a process up to a charge transport layer was previously conducted, employing a circular shape slide hopper. After coating followed by drying at room temperature for 20 minutes (solvent drying step), light exposure was conducted with a metal halide lamp (500 W) for one minute while rotating the photoreceptor at a distance of 100 mm (UV curable step) to obtain a protective layer having a layer thickness of 3 μm.

Preparation of Photoreceptors 2-27

Photoreceptors 2-27 were prepared similarly to preparation of photoreceptor 1, except that materials used for a protective layer of photoreceptor 1 and the curing condition were replaced by those shown in Table 1.

Curing condition (light): Light exposure was conducted with a metal halide lamp (500 W) for one minute while rotating the photoreceptor at a distance of 100 mm to obtain a protective layer having a layer thickness of 3 μm.

Curing condition (heat): heating was conducted at 140° C. for 30 minutes to obtain a protective layer having a layer thickness of 3 μm.

(Preparation of Comparative Photoreceptor)

A photoreceptor in which an intermediate layer, a charge generation layer and a charge transport layer are laminated is formed similarly to preparation of photoreceptor 1 up to formation of the charge transport layer, but no protective layer is provided.

Photoreceptor 29 (an Alumina Surface Treatment with No Reactive Organic Group)

A photoreceptor in which an intermediate layer, a charge generation layer and a charge transport layer were laminated was formed similarly to formation of photoreceptor 1.

A protective layer was provided similarly to Example 1, except that alumina particles each having a reactive group were replaced by alumina particles having a primary particle diameter of 6 nm, having been subjected to a surface treatment with isobutyltrimethoxysilane of the same weight as that of the alumina particles.

Photoreceptor 30 (a Glass Film Formed Via Sol-Gel Film Formation)

A photoreceptor in which an intermediate layer, a charge generation layer and a charge transport layer were laminated was formed similarly to formation of photoreceptor 1. A coating solution in which the following materials were mixed and dissolved was coated on a charge transport layer employing a circular shape slide hopper, followed by drying with heat at 140° C. for 30 minutes to place a protective layer having a layer thickness of 3 μm.

| | |
|---|---|
| Retraethoxysilane | 10 parts |
| Ethanol | 100 parts |

Photoreceptor 31 (a Curable Compound Only with No Alumina)

A photoreceptor in which an intermediate layer, a charge generation layer and a charge transport layer were laminated was formed similarly to formation of photoreceptor 1.

A protective layer was provided similarly to Example 1, except that alumina particles each having a reactive group were excluded.

Photoreceptor 32 (Silica Having No Reactive Organic Group and a Curable Compound)

A photoreceptor in which an intermediate layer, a charge generation layer and a charge transport layer were laminated was formed similarly to formation of photoreceptor 1.

A protective layer was provided similarly to Example 1, except that alumina particles each having a reactive group were replaced by silica particles having a primary particle diameter of 10 nm, having been subjected to a surface treatment with isobutyltrimethoxysilane of the same weight as that of the silica particles.

[Evaluation of Photoreceptor]

(Surface Scratch)

Each of the resulting photoreceptor was evaluated as described below.

A photoreceptor was installed in an evaluation machine in which a light exposure amount was optimized after modifying bizhub PRO C6500, produced by Konica Minolta Business Technologies Inc. (a tandem color complex machine with laser light exposure, reversal development and an intermediate transfer member) so as to make evaluations. The surface condition of the photoreceptor was observed before or after printing an A4 image having a printing ratio of 2.5% for each color of Y, M, C and Bk at 20° C. and 50% RH onto each of 1,000,000 neutral paper sheets to evaluate scratches. The photoreceptor to be evaluated was placed at the cyan position.

A: No surface scratch observed after printing 1,000,000 sheets (Excellent)

B: One to ten surface scratches generated after printing 1,000,000 sheets (Practically acceptable)

C: At least 11 surface scratches generated after printing 1,000,000 sheets (Practically unacceptable)

(Wastage Amount of Photoreceptor)

The 1,000,000$^{th}$ image was produced through the above-described evaluation, and evaluations were made with the initial layer thickness and the layer thickness after printing 1,000,000 sheets. As to the layer thickness of the photoreceptor, 10 points in uniform in layer thickness portions are randomly measured, and the mean value is designated as thickness of a photosensitive layer. Thickness of the photoreceptor at 10 points at uniform thickness portion were randomly measured (excluding at least 3 cm from each of both ends, since thickness of the photoreceptor at each of both ends becomes uneven), and the average of them was referred to the thickness of the photoreceptor. The thickness is measured by an eddy current system thickness measuring device EDDY 560C (manufactured by HELMUT FISCHER GMBTE CO.) as a thickness meter, and thickness difference of the photosensitive layer obtained before and after the practical printing test is designated as the wastage amount in thickness.

A: A wastage amount in thickness is 1 μm or less. (Excellent)

B: A wastage amount in thickness is 1-3 μm. (Practically acceptable)

C: A wastage amount in thickness exceeds 3 μm. (Practically unacceptable)

(Image Blur)

An A4 image was printed onto each of 25,000 neutral paper sheets under the evaluation condition except that the environment condition was replaced by 30° C. and 80% RH to evaluate scratches, and the main power supply was turned off in 60 seconds after completion of printing. A half tone image on the entire surface of a A3 neutral paper sheet (a relative reflection density of 0.4 measured by a Macbeth densitometer) and a 6 dot lattice image on the entire surface of a A3 paper sheet were printed immediately after a printable situation became available by turning on the power supply 12 hours after being turned off. The following evaluations were made by observing printed images.

A: No blur is observed both in a half tone image and a lattice image. (Excellent)

B: A belt-shaped density drop in the long axis of the photoreceptor is slightly observed only in a half tone image. (Practically acceptable)

C: Defects on a lattice image or thinning of a line width caused by the image blur is generated.

(Practically Unacceptable)

Evaluated results are summarized in the following Table 1.

TABLE 1

| | Alumina particle | | | | Curable compound | | | Polymerization initiator | | | Evaluation | | |
|---|---|---|---|---|---|---|---|---|---|---|---|---|---|
| Photo-receptor No. | Primary particle diameter (nm) | Surface treatment agent | Ratio of surface treatment agent to alumina | Weight ratio | Exem-plified com-pound | Parts | Ac/M | Exem-plified com-pound | Parts | Curing condition | Surface scratch | Wastage amount of photo-receptor | Image blur |
| 1 | 6 | S-15 | 100/100 | 100 | 31 | 100 | 0.011 | 1-6 | 30 | Light | A | A | B |
| 2 | 6 | S-15 | 100/100 | 100 | 7 | 100 | 0.01 | 1-6 | 30 | Light | A | A | B |
| 3 | 6 | S-15 | 100/100 | 100 | 9 | 100 | 0.0067 | 1-6 | 30 | Light | B | A | B |
| 4 | 6 | S-15 | 100/100 | 100 | 42 | 100 | 0.0089 | 1-6 | 30 | Light | A | A | A |
| 5 | 6 | S-15 | 100/100 | 100 | 43 | 100 | 0.0091 | 1-6 | 30 | Light | A | A | A |
| 6 | 6 | S-30 | 100/100 | 100 | 31 | 100 | 0.011 | 1-6 | 30 | Light | A | A | B |
| 7 | 6 | S-15 | 100/100 | 100 | 31 | 100 | 0.011 | 5-1 | 30 | Heat | B | B | A |
| 8 | 6 | S-15 | 100/100 | 100 | 43 | 100 | 0.0091 | 5-1 | 30 | Heat | B | B | A |
| 9 | 30 | S-15 | 30/100 | 100 | 42 | 100 | 0.0089 | 1-6 | 30 | Light | A | A | A |
| 10 | 100 | S-15 | 10/100 | 100 | 42 | 100 | 0.0089 | 1-6 | 30 | Light | A | A | A |
| 11 | 6 | S-15 | 100/100 | 100 | — | — | — | 1-6 | 15 | Light | B | B | B |
| 12 | 10 | S-15 | 100/100 | 100 | 31 | 100 | 0.011 | 1-6 | 30 | Light | A | A | B |
| 13 | 20 | S-15 | 100/100 | 100 | 7 | 100 | 0.0078 | 1-6 | 30 | Light | A | A | B |
| 14 | 50 | S-15 | 100/100 | 100 | 9 | 100 | 0.0067 | 1-6 | 30 | Light | B | A | B |
| 15 | 70 | S-15 | 100/100 | 100 | 42 | 100 | 0.0089 | 1-6 | 30 | Light | A | A | A |
| 16 | 6 | S-1 | 10/100 | 100 | 42 | 100 | 0.0089 | 1-6 | 30 | Light | B | A | B |
| 17 | 6 | S-7 | 100/100 | 100 | 42 | 100 | 0.0089 | 1-6 | 30 | Light | A | A | B |
| 18 | 6 | S-8 | 100/100 | 100 | 42 | 100 | 0.0089 | 1-6 | 30 | Light | B | A | B |
| 19 | 6 | S-14 | 100/100 | 100 | 42 | 100 | 0.0089 | 1-6 | 30 | Light | B | A | A |
| 20 | 6 | S-16 | 100/100 | 100 | 42 | 100 | 0.0089 | 1-6 | 30 | Light | B | A | B |
| 21 | 10 | S-21 | 100/100 | 100 | 42 | 100 | 0.0089 | 1-6 | 30 | Light | B | A | B |
| 22 | 10 | S-22 | 100/100 | 100 | 42 | 100 | 0.0089 | 1-6 | 30 | Light | B | A | B |
| 23 | 10 | S-23 | 100/100 | 100 | 42 | 100 | 0.0089 | 1-6 | 30 | Light | B | A | B |
| 24 | 10 | S-26 | 100/100 | 100 | 42 | 100 | 0.0089 | 1-6 | 30 | Light | A | A | B |
| 25 | 10 | S-31 | 100/100 | 100 | 42 | 100 | 0.0089 | 1-6 | 30 | Light | B | A | B |
| 26 | 10 | S-35 | 100/100 | 100 | 57 | 100 | — | 6-5 | 30 | Heat | B | B | B |
| 27 | 6 | S-37 | 100/100 | 100 | 47 | 100 | — | 6-6 | 30 | Light | B | B | B |
| 28 | — | — | — | — | — | — | — | — | — | — | C | C | B |
| 29 | 6 | Isobutyl-trimethoxy-silane | 100/100 | 100 | 31 | 100 | 0.011 | 1-6 | 30 | Light | C | C | B |
| 30 | — | — | — | — | — | — | — | — | — | — | B | B | C |
| 31 | — | — | — | — | 42 | 100 | 0.0089 | 1-6 | 30 | Light | C | C | B |
| 32 | — | — | — | — | 31 | 100 | 0.011 | 1-6 | 30 | Light | C | C | C |

As is clear from Table 1, it is found out that photoreceptors 1-27 in the invention of the present application result in more than practical availability in each evaluation item, but photoreceptors 28-32 as comparative examples exhibit a practical problem produced in any of the evaluation items.

EXPLANATION OF NUMERALS

10Y, 10M, 10C, 10Bk Image forming unit

1Y, 1M, 1C, 1Bk Photoreceptor

2Y, 2M, 2C, 2Bk Charging device

3Y, 3M, 3C, 3Bk Light exposure device

4Y, 4M, 4C, 4Bk Developing device

The invention claimed is:

1. An organic photoreceptor comprising a conductive support and provided thereon, a photosensitive layer and a protective layer provided on the photosensitive layer, the protective layer formed with alumina particles each comprising a reactive organic group, wherein the reactive organic group comprises a group comprising a C═C double bond.

2. The organic photoreceptor of claim 1, wherein the alumina particles each comprising a reactive organic group are obtained via reaction of alumina particles and a silane compound comprising a reactive organic group.

3. The organic photoreceptor of claim 2, wherein the reactive organic group in the silane compound comprising the reactive organic group comprises a polymerizable functional group.

4. The organic photoreceptor of claim 3, wherein the silane compound comprising the reactive organic group is represented by the following Formula (1):

Formula (1)

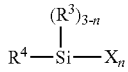

wherein $R^3$ represents an alkyl group having 1-10 carbon atoms or an aralkyl group having 1-10 carbon atoms, $R^4$ represents an organic group having a polymerizable double bond, X represents a halogen atom, an alkoxy group, an acyloxy group, an aminoxy group or a phenoxy group, and n is an integer of 1-3.

5. The organic photoreceptor of claim 4, wherein the alumina particles have a number average primary particle diameter of 1-300 nm.

6. The organic photoreceptor of claim 1, comprising the protective layer formed via reaction produced by using a curable compound and the alumina particles each comprising the reactive organic group.

7. The organic photoreceptor of claim 6, wherein the curable compound is a compound comprising a C═C double bond.

8. The organic photoreceptor of claim 7, wherein the compound comprising a C═C double bond is a compound comprising an acryloyl group or a methacryloyl group.

9. The organic photoreceptor of claim 8, wherein a ratio Ac/M is within the following range, wherein Ac represents the number of the acryloyl groups or the methacryloyl groups, and M represents molecular weight of the compound comprising the acryloyl group or the methacryloyl group:

$$0.005 < Ac/M < 0.012.$$

10. The organic photoreceptor of claim 1, wherein the reactive organic group comprises a polymerizable functional group such that the polymerizable functional group comprises a radical polymerizable functional group.

11. The organic photoreceptor of claim 1, comprising the protective layer formed via reaction between the alumina particles each comprising the reactive organic group to each other.

12. An image forming apparatus comprising a charging device, a light exposure device and a developing device around the organic photoreceptor of claim 1 to form images repetitively.

13. A process cartridge used for the image forming apparatus of claim 12 comprising the organic photoreceptor and at least one of a charging device, an imagewise light exposure device and a developing device integrally, the process cartridge installed in the image forming apparatus as a detachable unit.

* * * * *